US008169293B2

(12) United States Patent
Hemmingway et al.

(10) Patent No.: US 8,169,293 B2
(45) Date of Patent: May 1, 2012

(54) FUSE ELEMENT RETAINING DEVICE

(76) Inventors: Wayne Hemmingway, Stonewall, MS (US); Henry D. Henderson, Gulfport, MS (US)

( * ) Notice: Subject to any disclaimer, the term of this patent is extended or adjusted under 35 U.S.C. 154(b) by 252 days.

(21) Appl. No.: 12/591,362

(22) Filed: Nov. 17, 2009

(65) Prior Publication Data

US 2010/0148913 A1 Jun. 17, 2010

Related U.S. Application Data

(60) Provisional application No. 61/193,691, filed on Dec. 16, 2008.

(51) Int. Cl.
*H01H 85/20* (2006.01)
*H01H 85/48* (2006.01)

(52) U.S. Cl. ..... 337/215; 337/165; 337/208; 337/213; 337/214

(58) Field of Classification Search ..... 337/5, 165, 337/169, 214, 261, 178, 227, 208, 213, 215; 361/104
See application file for complete search history.

(56) References Cited

U.S. PATENT DOCUMENTS

| | | | | | |
|---|---|---|---|---|---|
| 2,004,314 | A | | 6/1935 | Dante | |
| 2,108,993 | A | * | 2/1938 | Ramsey | 337/202 |
| 2,591,949 | A | * | 4/1952 | Lindell et al. | 439/698 |
| 3,249,719 | A | * | 5/1966 | Misare et al. | 337/32 |
| 3,287,690 | A | | 11/1966 | Book | |
| 3,637,918 | A | * | 1/1972 | Pasen | 174/158 R |
| 3,890,032 | A | | 6/1975 | Tillson | |
| 3,984,801 | A | | 10/1976 | Mrenna et al. | |
| 4,041,435 | A | * | 8/1977 | Gaia | 337/159 |
| 4,053,861 | A | * | 10/1977 | Knapp, Jr. | 337/165 |
| 4,082,408 | A | * | 4/1978 | Angelis | 439/698 |
| 4,097,114 | A | | 6/1978 | Motten, Jr. | |
| 4,108,531 | A | | 8/1978 | Reynolds | |
| 4,257,662 | A | * | 3/1981 | Motten, Jr. | 439/831 |
| 4,278,316 | A | | 7/1981 | White | |
| 4,547,036 | A | | 10/1985 | Keglewitsch et al. | |
| 4,593,262 | A | * | 6/1986 | Krueger | 337/163 |
| 4,616,207 | A | * | 10/1986 | Knapp et al. | 338/32 H |
| 4,759,730 | A | * | 7/1988 | Sappington et al. | 439/620.3 |
| 4,761,148 | A | | 8/1988 | Sappington | |
| 4,806,898 | A | * | 2/1989 | Osborne | 337/146 |
| 4,846,738 | A | | 7/1989 | Herbert | |
| 4,971,582 | A | | 11/1990 | Keglewitsch et al. | |
| 5,128,648 | A | * | 7/1992 | Brandi | 337/169 |
| 5,213,298 | A | * | 5/1993 | Johnson | 248/313 |
| 5,475,570 | A | * | 12/1995 | Harr | 361/825 |
| 5,796,326 | A | * | 8/1998 | Benito | 337/169 |
| 5,982,267 | A | * | 11/1999 | Locht | 337/186 |
| 6,304,429 | B1 | * | 10/2001 | Locht et al. | 361/623 |
| D517,504 | S | | 3/2006 | Kitajima et al. | |
| 7,378,933 | B2 | * | 5/2008 | Rogers | 337/227 |
| 7,834,738 | B2 | * | 11/2010 | Muench et al. | 337/228 |
| 2003/0049955 | A1 | | 3/2003 | Schilling | |

* cited by examiner

*Primary Examiner* — Anatoly Vortman
(74) *Attorney, Agent, or Firm* — Richard C. Litman

(57) ABSTRACT

The fuse element retaining device is an L-shaped bracket having a long leg and a short leg. The short leg has a notch and a plurality of vent holes surrounding the notch. At least one clip is provided for mounting the long leg of the L-shaped bracket to a fuse holder barrel. The fuse holder barrel has a top end and a bottom end. When the long leg of the L-shaped bracket is mounted to the fuse holder barrel, the short leg is positioned with the vent holes over the bottom end of the fuse holder barrel. The vent holes are for venting propellant gases during a discharge when a fuse element blows. The notch receives a part of the fuse element from the fuse holder barrel and minimizes projectiles from the fuse element heading towards the ground at very high speeds when the fuse element blows during the discharge.

13 Claims, 4 Drawing Sheets

FUSE ELEMENT RETAINING DEVICE

CROSS-REFERENCE TO RELATED APPLICATION

This application claims the benefit of U.S. Provisional Patent Application Ser. No. 61/193,691, filed Dec. 16, 2008.

BACKGROUND OF THE INVENTION

1. Field of the Invention

The present invention relates to high-voltage electrical equipment, and particularly to a high-voltage fuse element retaining device for preventing a fuse element from discharging away from a fuse barrel after the fuse is blown.

2. Description of the Related Art

Single-phase and three-phase electrical power is delivered to commercial, industrial and residential users through a system commonly known as the "power distribution grid", which generally includes such components as generating plants, transformers, and electrical power lines. These lines generally include both transmission lines, which typically have AC voltages in the range of about 70,000 V to about 750,000 V, and distribution lines, which typically have AC voltages in the range of about 2,300 V to about 50,000 V. Utility workers often must either service or replace high voltage power lines in the course of regular maintenance, despite the inherent danger in working with such high voltages. These service and repair duties often include the replacement of power line fuses, which, when operable, can carry hundreds of amperes of electrical current and, even when inoperable, may form part of an energized circuit carrying thousands of volts of electrical potential, which may still be available at the load side of the fuse.

Generally, power line fuses are located at or near the tops of power poles, positioning these fuses over thirty feet above the surface of the ground. Each fuse is generally carried in a fuse holder, which is commonly referred to as a "fuse barrel assembly", typically including a fuse holder barrel and providing an interface between the fuse and the fuse block connected to the power line. The bottom end of the fuse barrel assembly has a hinge assembly that includes an ejection assembly for automatically releasing the top end of a blown fuse from a fuse block, along with a pair of pivot pins (typically one pin on each side of the hinge assembly) that are adapted to fit into slots formed on the bottom of the fuse block. The top end of the fuse barrel assembly typically includes a hoop, a pull-ring or a similar structure. When the fuse element is blown, the fuse element is thrown by conversion of electrical energy into kinetic energy, becoming a projectile and traveling at a high rate of speed toward the ground. Any utility workman, utility employee or other individual in the vicinity of this projectile can be seriously injured.

Thus, a fuse element retaining device solving the aforementioned problems is desired.

SUMMARY OF THE INVENTION

The fuse element retaining device is an L-shaped bracket having a long leg and a short leg. The short leg has a notch and a plurality of vent holes surrounding the notch. At least one clip is provided for mounting the long leg of the L-shaped bracket to a fuse holder barrel. The fuse holder barrel has a top end and a bottom end. When the long leg of the L-shaped bracket is mounted to the fuse holder barrel, the short leg is positioned with the vent holes over the bottom end of the fuse holder barrel. The vent holes are for venting propellant gases during a discharge when a fuse element blows. The notch receives a part of the fuse element from the fuse holder barrel and prevents projectiles from the fuse element heading towards the ground at very high speeds when the fuse element blows during the discharge.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
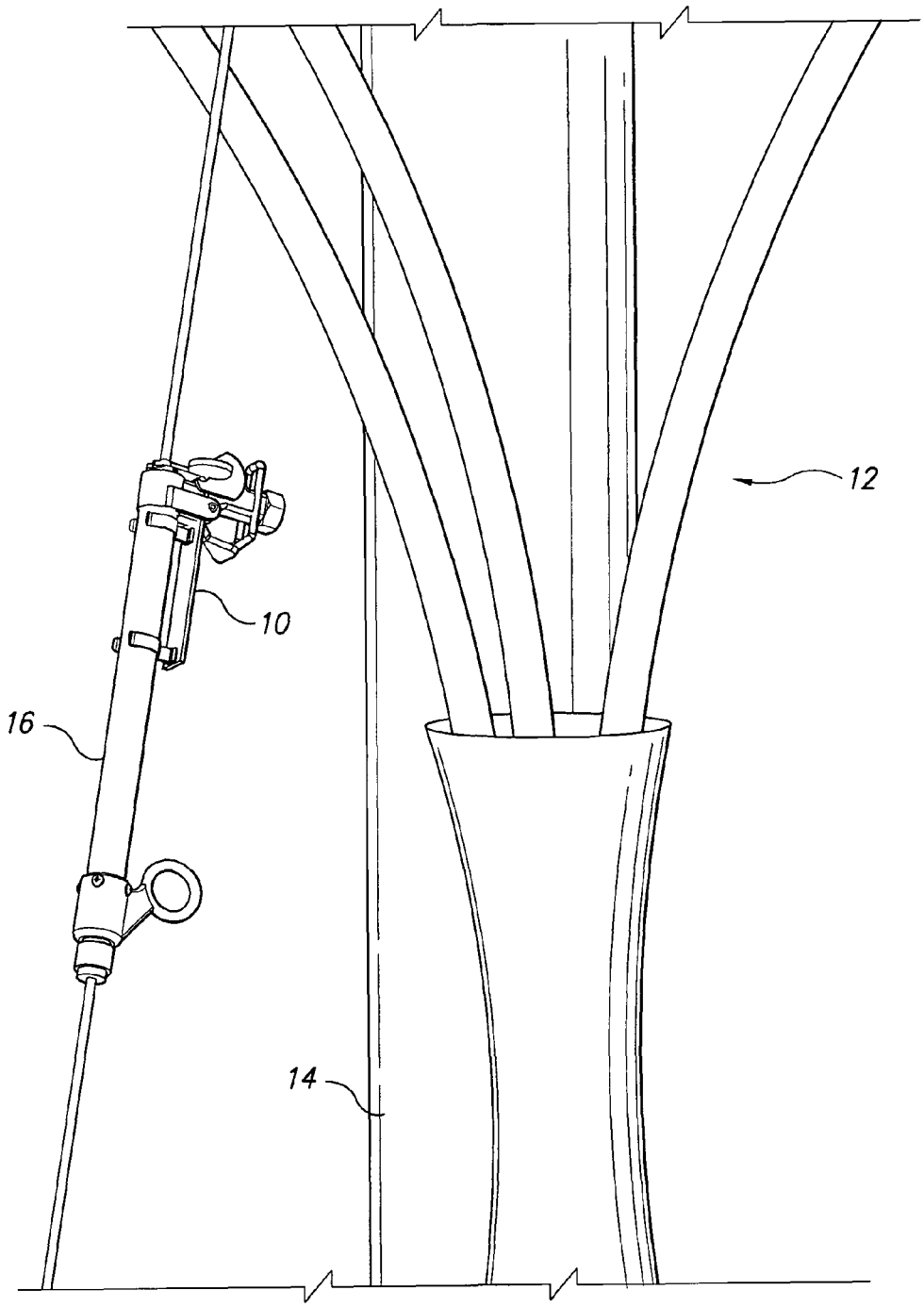
FIG. 1 is an environmental, perspective view of a fuse element retaining device according to the present invention.
Figure 2:
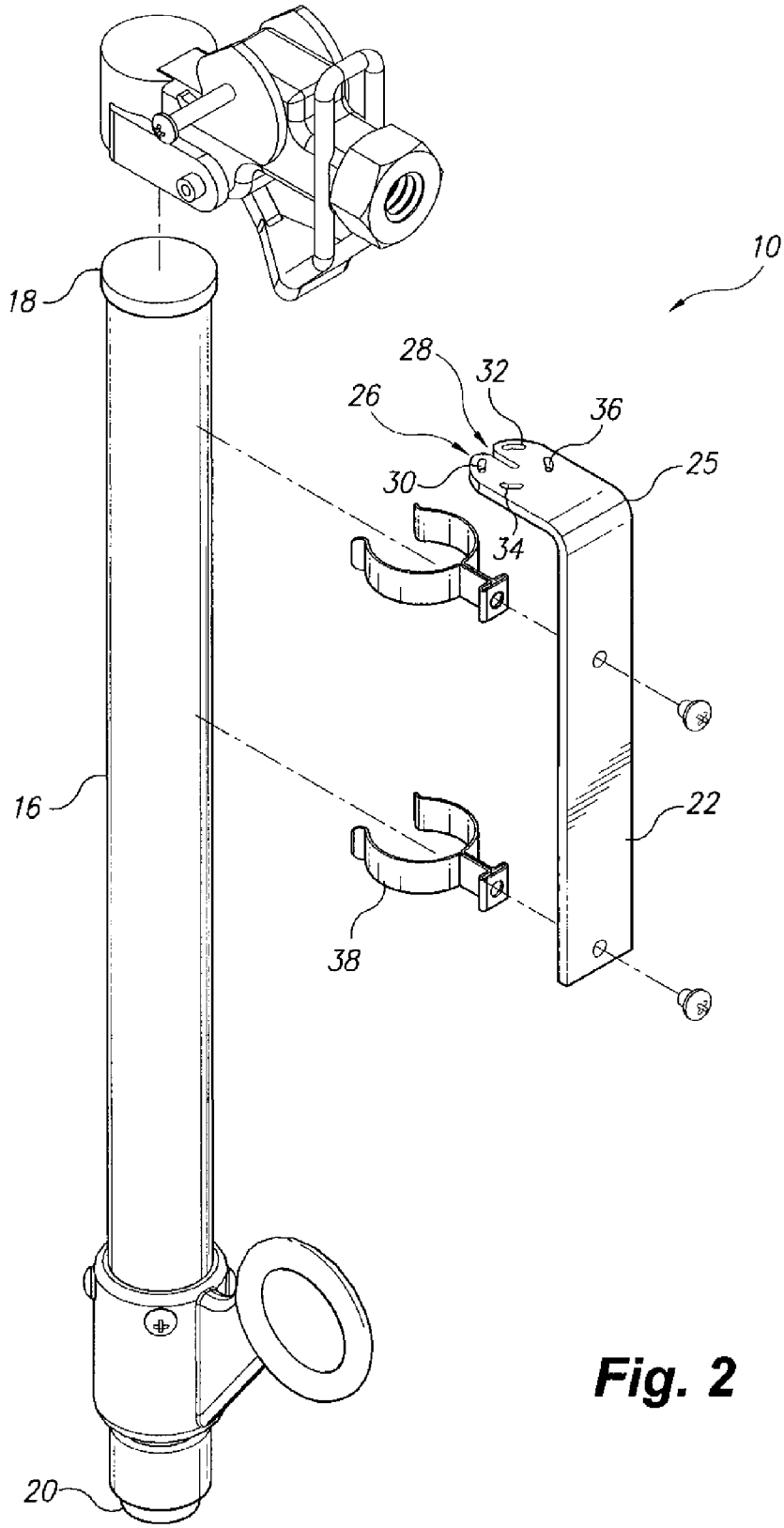
FIG. 2 is a perspective view of the fuse element retaining device of FIG. 1, shown exploded from a fuse holder.

The fuse element retaining device is shown in FIGS. 1-4, and is generally indicated by the numeral 10. The fuse element retaining device 10 is utilized in an environment of high-voltage power lines 12. The power lines 12 are supported by a common power line pole 14. A fuse is held inside a fuse holder barrel 16. The fuse holder barrel 16 includes a bottom end 18 and a top end 20.

Figure 4:
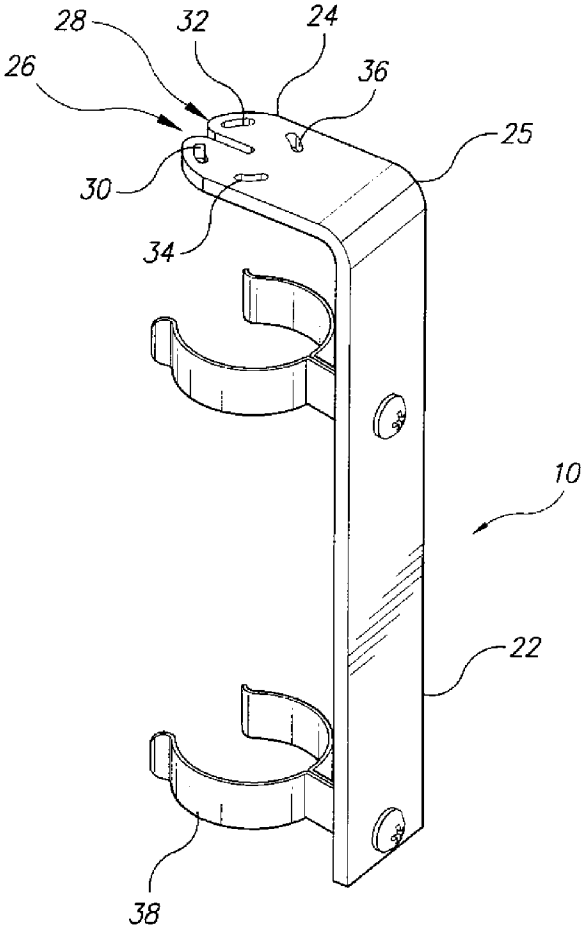
FIG. 4 is a rear perspective view of the fuse element retaining device according to the present invention.
Figure 3:
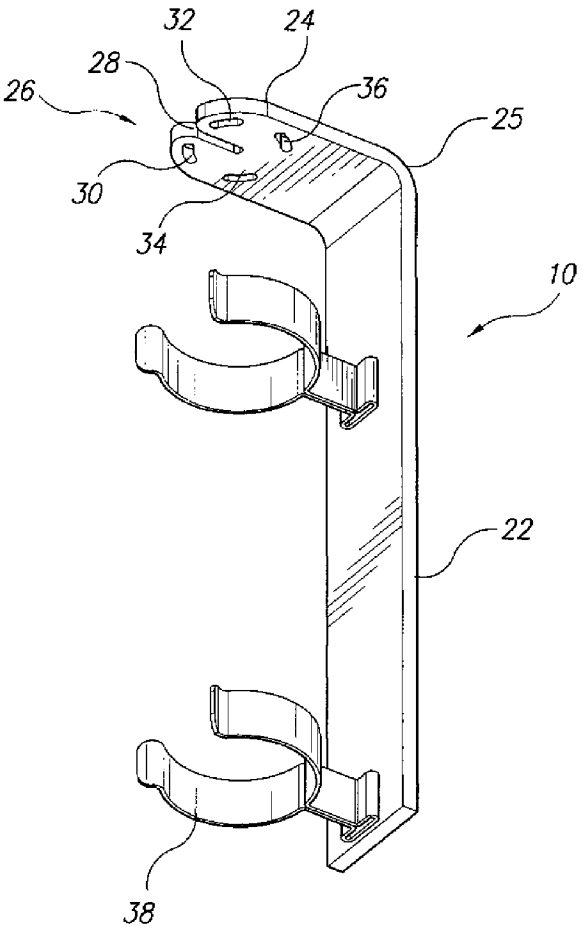
FIG. 3 is a perspective view of the fuse element retaining device according to the present invention.

As shown in FIGS. 3 and 4, the fuse element retaining device 10 is an L-shaped bracket having a long leg 22 and a short leg 24. The short leg 24 extends perpendicularly from the long leg 22, with a 90° angle being formed at a joint 25. The short leg 24 extends outwardly from the joint 25 and has a rounded end 26. The rounded end 26 has an elongated notch 28 defined in the rounded end 26 that extends toward the joint 25. The notch 28 is dimensioned and configured to receive a cable that extends from the fuse element inside the barrel holder 16 when the notch 28 is aligned with bottom end 18. A plurality of vent holes 30, 32, 34, 36 are defined in the short leg 24 surrounding the notch 28. The vent holes 30, 32, 34, 36 are arcuate and arranged generally in a circle at the notch end 26 of the short leg 24.

The fuse element retaining device is an L-shaped bracket having a long leg and a short leg. The short leg has a notch and a plurality of vent holes surrounding the notch. At least one clip is provided for mounting the long leg of the L-shaped bracket to a fuse holder barrel. The fuse holder barrel has a top end and a bottom end. When the long leg of the L-shaped bracket is mounted to the fuse holder barrel, the short leg is positioned with the vent holes over the bottom end of the fuse holder barrel. The vent holes are for venting propellant gases during a discharge when a fuse element blows. The notch receives a part of the fuse element from the fuse holder barrel and prevents projectiles from the fuse element heading towards the ground at very high speeds when the fuse element blows during the discharge.

Figure 5:
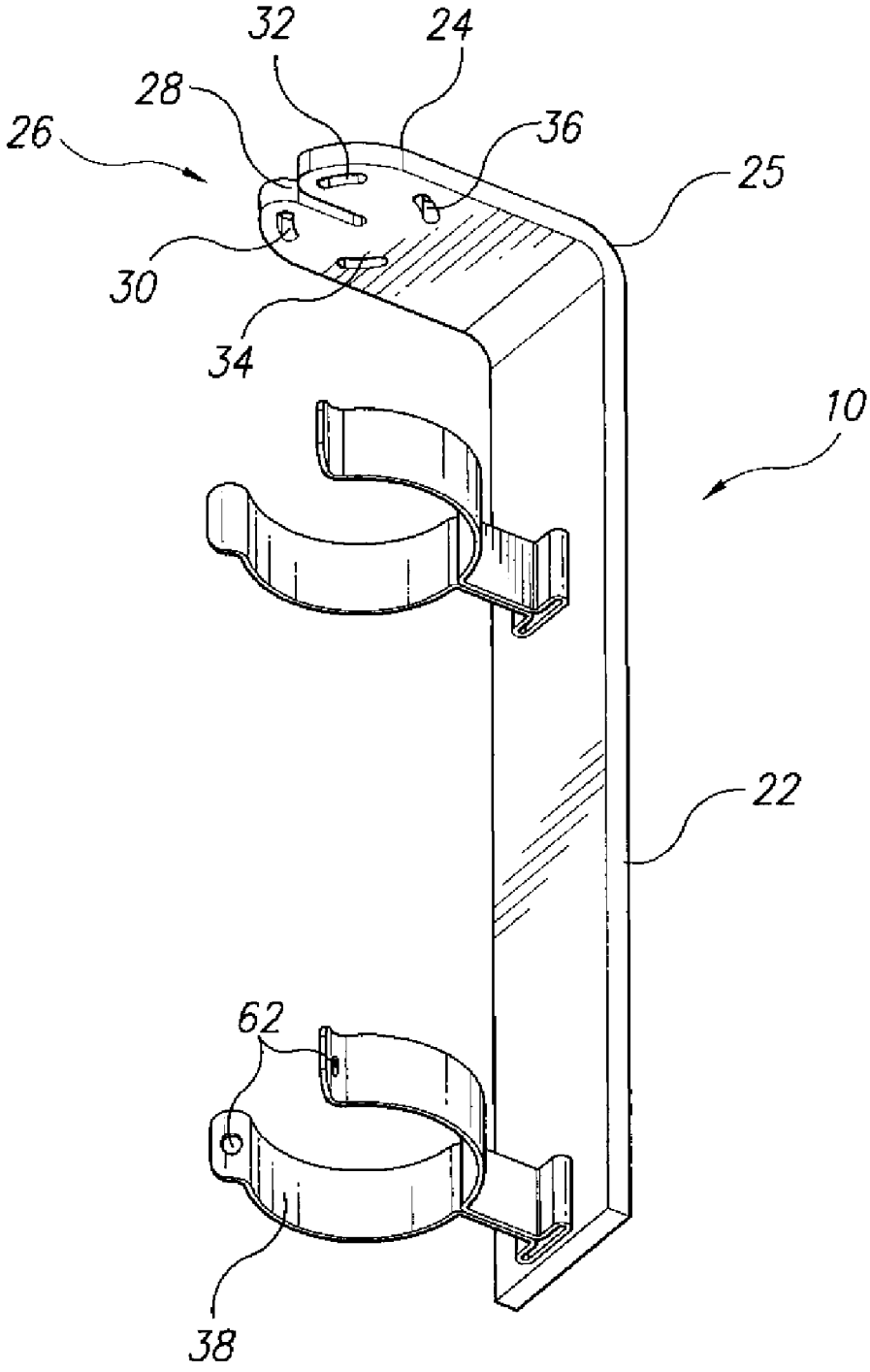
FIG. 5 is a perspective view of an alternative embodiment of a fuse element retaining device according to the present invention.

In FIG. 5, a fuse element retaining device 10 is shown that has a pair of openings 62 formed through the ends of the C-shaped portion of the clip 38 farthest away from the short leg 24. The openings 62 are provided so that an additional safety wire may be inserted through the openings 62.

It is to be understood that the present invention is not limited to the embodiment described above, but encompasses any and all embodiments within the scope of the following claim.

We claim:

1. A fuse element retaining device, comprising:

an L-shaped bracket having a long leg and a short leg extending normal to the long leg, the short leg having a notch defined axially therein; and at least one clip extending from the long leg, the at least one clip being adapted for mounting the long leg of the L-shaped bracket to a fuse holder barrel with the short leg extending across a bottom end of the fuse holder barrel, the notch being dimensioned and configured for receiving a cable lead extending from a fuse element through the bottom end of the fuse holder barrel, the short leg preventing the fuse element from projecting out of the fuse holder barrel when the fuse element blows, wherein the short leg further has a plurality of vent holes formed therethrough, the plurality of vent holes being disposed around the notch for venting gases when the fuse element blows.

2. The fuse element retaining device as recited in claim 1, wherein the short leg of said L-shaped bracket has a rounded end, the notch extending through the rounded end.

3. The fuse element retaining device as recited in claim 1, wherein said at least one clip comprises:

a substantially C-shaped portion;

a stem having opposed first and second ends, the first end extending from the substantially C-shaped portion; and a base attached to the second end of the stem, the base being attached to the long leg of said L-shaped bracket.

4. The fuse element retaining device as recited in claim 3, further comprising threaded fasteners releasably attaching the base to the long leg of said L-shaped bracket.

5. The fuse element retaining device as recited in claim 1, wherein said at least one clip comprises a pair of clips spaced apart on the long leg of said L-shaped bracket.

6. A fuse element retaining device, comprising:

an L-shaped bracket having a long leg and a short leg extending normal to the long leg, the short leg having a notch defined axially therein; and means for releasably attaching the substantially L-shaped bracket to a fuse holder barrel so that the short leg extends across a bottom end of the fuse holder barrel, the notch being dimensioned and configured for receiving a fuse lead extending from a fuse element through the bottom end of the fuse holder barrel, whereby the short leg prevents the fuse element from projecting out of the fuse holder barrel when the fuse element blows, wherein the short leg further has a plurality of vent holes formed therethrough, the plurality of vent holes being disposed around the notch for venting gases when the fuse element blows.

7. The fuse element retaining device as recited in claim 6, wherein said means for releasably securing the substantially L-shaped bracket to the fuse holder barrel comprises at least one clip.

8. The fuse element retaining device as recited in claim 7, wherein the at least one clip comprises:

a substantially C-shaped portion;

a stem having opposed first and second ends, the first end being attached to the substantially C-shaped portion; and a base attached to the second end of the stem.

9. The fuse element retaining device as recited in claim 8, further comprising means for securing the base of the at least one clip to the long leg.

10. The fuse element retaining device as recited in claim 8, wherein the at least one clip comprises a pair of clips.

11. The fuse element retaining device as recited in claim 8, wherein the short leg has a rounded end.

12. A fuse element retaining device for retaining a high-voltage fuse element in a fuse holder barrel when the fuse element blows, the retaining device comprising:

an L-shaped bracket having a long leg and a short leg extending normal to the long leg, the short leg having an end having rounded edge, a notch extending through the rounded edge into the short leg, and a plurality of vent holes defined in the short leg distributed around the notch; and a pair of C-shaped clips extending from the long leg, the clips being adapted for mounting the long leg of the L-shaped bracket to the fuse holder barrel with the short leg extending across a bottom end of the fuse holder barrel, the notch being dimensioned and configured for receiving a fuse lead extending from a fuse element through the bottom end of the fuse holder barrel, the short leg preventing the fuse element from projecting out of the fuse holder barrel when the fuse element blows, the vent holes permitting escape of propellant gases from the fuse element when the fuse element blows.

13. The fuse element retaining device according to claim 12, wherein at least one of the C-shaped clips has opposing elongated arms having openings defined in the ends thereof adapted for inserting a security device therethrough to further secure the fuse holder barrel to the L-shaped bracket.

* * * * *